US007911426B2

(12) United States Patent
Eom et al.

(10) Patent No.: US 7,911,426 B2
(45) Date of Patent: Mar. 22, 2011

(54) LIGHT EMITTING DISPLAY WITH EXTERNAL DRIVING VOLTAGE PROVIDED AT A SINGLE SIDE

(75) Inventors: Ki Myeong Eom, Suwon (KR); June Young Song, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1026 days.

(21) Appl. No.: 11/237,641

(22) Filed: Sep. 27, 2005

(65) Prior Publication Data

US 2006/0077144 A1 Apr. 13, 2006

(30) Foreign Application Priority Data

Oct. 8, 2004 (KR) ..... 10-2004-0080625

(51) Int. Cl.
*G09G 3/32* (2006.01)

(52) U.S. Cl. ..... 345/82; 345/77

(58) Field of Classification Search ..... 345/36, 345/39, 44–46, 76–83, 204–215, 690–699, 345/87–111; 313/463; 315/169.1–169.3
See application file for complete search history.

(56) References Cited

U.S. PATENT DOCUMENTS

| | | | | |
|---|---|---|---|---|
| 6,903,513 | B2 * | 6/2005 | Choi et al. | 315/169.3 |
| 2002/0011976 | A1 * | 1/2002 | Hashimoto | 345/76 |
| 2004/0004444 | A1 * | 1/2004 | Choi et al. | 315/169.2 |
| 2004/0061694 | A1 * | 4/2004 | Noguchi et al. | 345/204 |

FOREIGN PATENT DOCUMENTS

| | | |
|---|---|---|
| JP | 2002-108252 | 4/2002 |
| JP | 2003-316291 | 11/2003 |

OTHER PUBLICATIONS

Patent Abstracts of Japan for Publication No. 2002-108252; dated Apr. 10, 2002 in the name of Naoiaki Furumiya.
Patent Abstracts of Japan for Publication No. 2003-316291; dated Nov. 7, 2003 in the name of Shunpei Yamazaki, et al.

* cited by examiner

*Primary Examiner* — Chanh Nguyen
*Assistant Examiner* — Long Pham
(74) *Attorney, Agent, or Firm* — Christie, Parker & Hale, LLP

(57) ABSTRACT

A light emitting display for providing a uniform current flow to a set of pixels to enable uniform brightness for the pixels. The pixels are situated in a pixel portion of a panel where the pixels are located at regions defined by a plurality of scan lines and a plurality of data lines. The uniform power is supplied by a set of power lines on each side of the pixel portion. The uniform voltage is maintained between the power lines by a set of power connection lines. The power connection lines connect the end points of two opposing power lines with interior points of the other two power lines at a set of electric junctions.

15 Claims, 6 Drawing Sheets

LIGHT EMITTING DISPLAY WITH EXTERNAL DRIVING VOLTAGE PROVIDED AT A SINGLE SIDE

CROSS-REFERENCE TO RELATED APPLICATIONS

This application claims priority to and the benefit of Korean Patent Application No. 10-2004-0080625, filed on Oct. 8, 2004, in the Korean Intellectual Property Office, the entire content of which is incorporated herein by reference.

BACKGROUND

1. Field of the Invention

The present invention relates to a light emitting display, and more particularly, to a light emitting display, in which a voltage drop in a power line is uniform, thereby providing a uniform brightness in the pixels.

2. Discussion of Related Art

Recently, various flat panel displays have been developed to replace a cathode ray tube (CRT) display, because the CRT display is relatively heavy and bulky. Flat panel display types include liquid crystal displays (LCDs), field emission displays (FEDs), plasma display panel (PDPs), light emitting display (LEDs), and similar flat panel technologies.

Light emitting displays include a plurality of light emitting devices, wherein each light emitting device emits light by electron-hole recombination or a similar process. Light emitting displays are classified into inorganic light emitting displays that include an inorganic emission layer and organic light emitting displays that include an organic emission layer. Light emitting displays have response times that are relatively fast and power consumption that is relatively low.

FIG. 1 is a plan view of a conventional light emitting display. A conventional light emitting display includes: a substrate 10, a pixel portion 20 that includes a plurality of pixels 21 formed adjacent to a region defined by a plurality of scan lines S, a plurality of data lines D and a plurality of pixel power lines VDD, which are formed on the substrate 10; a scan driver 30; a data driver 40; a first power line 50; a second pixel power line 52; and a pad hub 60.

The scan driver 30 is placed adjacent to one side of the pixel portion 20 and electrically connected to a first set of pads Ps on the pad hub 60 through a scan control signal line 32. The scan driver 30 generates scan signals in response to a scan control signal transmitted through the scan control line 32 and supplies the scan signals to the scan lines S of the pixel portion 20.

The data driver 40 is electrically connected to the data line D and the second set of pads Pd on the pad hub 60. The data driver 40 may be mounted as a chip onto the substrate 10.

The second pixel power line 52 is formed on the whole area of the pixel portion 20. The second pixel power line 52 supplies a second pixel driving voltage from the third set of pads Pvss on the pad hub 60 to each pixel 21.

The first power line 50 is placed adjacent to a top side of the pixel portion 20. The first power line 50 is commonly connected to the first ends of the first pixel power lines VDD. The first power line 50 receives the first pixel driving voltage from a first power supplying line 48 through a fourth set of pads Pvdd on the pad hub 60 and supplies it to the first pixel power line VDD of each pixel 21.

The respective first ends of the first pixel power lines VDD are commonly connected to the first power line 50. Each first pixel power line VDD supplies the first pixel driving voltage from the first power line 50 to each pixel 21.

Thus, each pixel 21 is controlled by the scan signal transmitted through the scan line S. Each pixel 21 emits light based on the current supplied from the first pixel power line VDD to the light emitting device in response to the data signal transmitted through the data line D, thereby displaying an image.

In the conventional light emitting display, the respective first pixel power lines VDD that are commonly connected to the first power line 50 are different in length, so that line resistance on the first pixel power lines is not uniform. Therefore, the voltage drop (i.e., IR drop) in the first pixel driving voltage supplied to the pixels 21 differs between pixels. That is, the voltage drop of the first pixel power line VDD becomes smaller as the first pixel power line VDD gets closer to the first power line 50, but becomes larger as it gets far away from the first power line 50. Hence, in the conventional light emitting display, the voltage drop in the first pixel power line VDD is different according to the position of the pixel 21, so that the intensity of current supplied to the pixel 21 is not uniform. Rather, the intensity of the current varies with respect to the same data signal according to the positions of the pixel 21, thereby making the brightness non-uniform.

SUMMARY OF THE INVENTION

Embodiments of the present invention provide a light emitting display, in which the voltage drop in the power lines is uniform to make brightness uniform. The embodiments of the invention include a light emitting display having: a pixel portion including a plurality of pixels defined by a plurality of scan lines and a plurality of data lines; a first power line arranged on a first side of the pixel portion for supplying a driving voltage; a second power line arranged on a second side of the pixel portion for supplying the driving voltage; a third power line arranged on a third side of the pixel portion for supplying the driving voltage; a fourth power line arranged on a fourth side of the pixel portion for supplying the driving voltage; first and second power connection lines to connect the first and second power lines with the third power line through first and second electric junctions; and third and fourth power connection lines to connect the first and second power lines with the fourth power line through third and fourth electric junctions, where each of the electric junctions are interior points on the third or fourth power lines.

In another embodiment, a light emitting display includes: a pixel portion including a plurality of pixels to emit light, where each pixel receives a current corresponding to a data signal that is transmitted through a data line and where each pixel is controlled by a scan signal transmitted through a scan line from a pixel power line; a first power line arranged on a first side of the pixel portion through which an external driving voltage is supplied; a second power line arranged on a second side of the pixel portion through which the external driving voltage is supplied; a third power line to supply the driving voltage to a first end of the pixel power line; a fourth power line to supply the driving voltage to a second end of the pixel power line; a first power connection line having a first end electrically connected to the first power line and a second end electrically connected between a first end and a middle of the third power line; a second power connection line having a first end electrically connected to the second power line and a second end electrically connected between a second end and the middle of the third power line; a third power connection line having a first end electrically connected to the first power line, and a second end electrically connected between a first end and a middle of the fourth power line; and a fourth power connection line having a first end electrically connected to the second power line and a second end electrically connected between a second end and the middle of the fourth power line.

DETAILED DESCRIPTION

Figure 1:
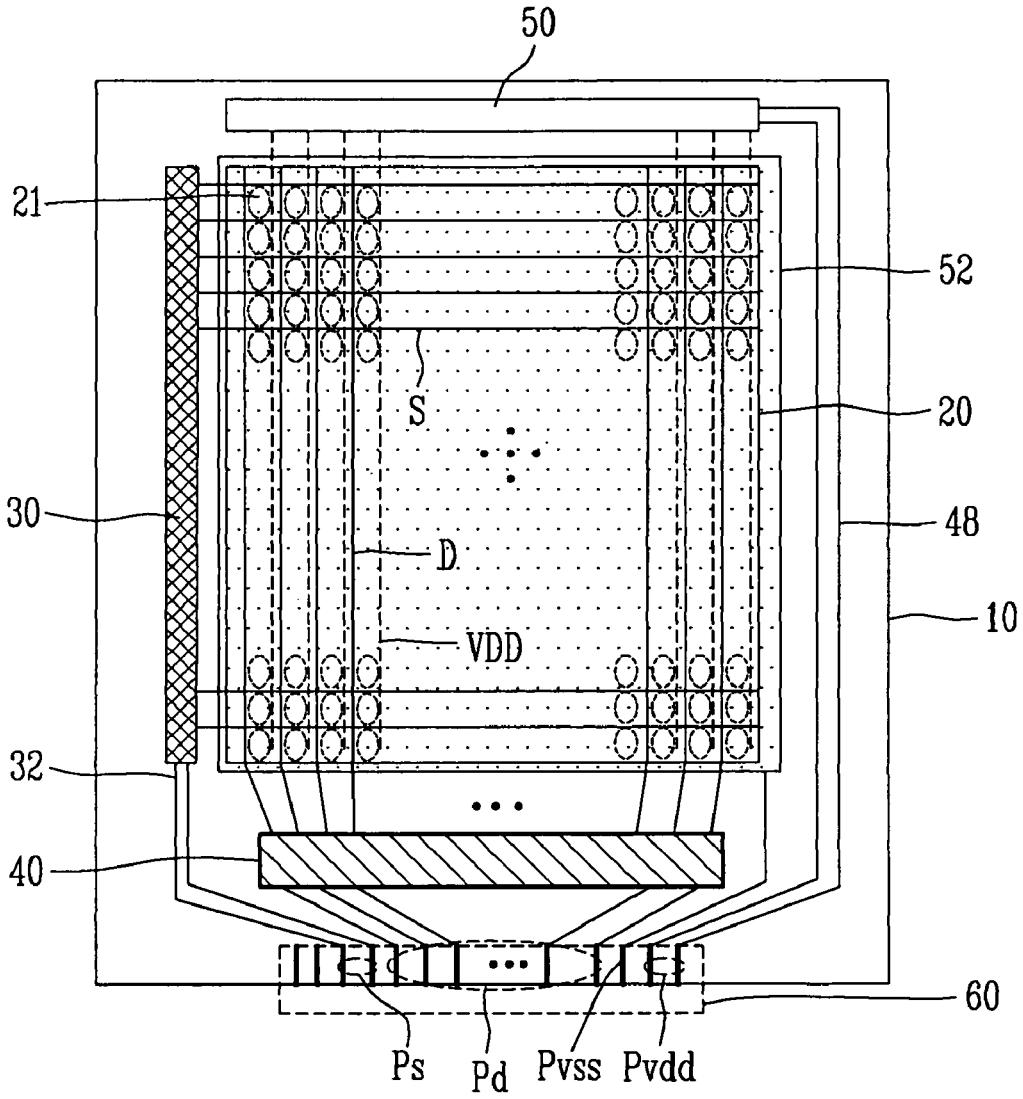
FIG. 1 (PRIOR ART)
FIG. 1 is a plan view of a conventional light emitting display.
Figure 2:
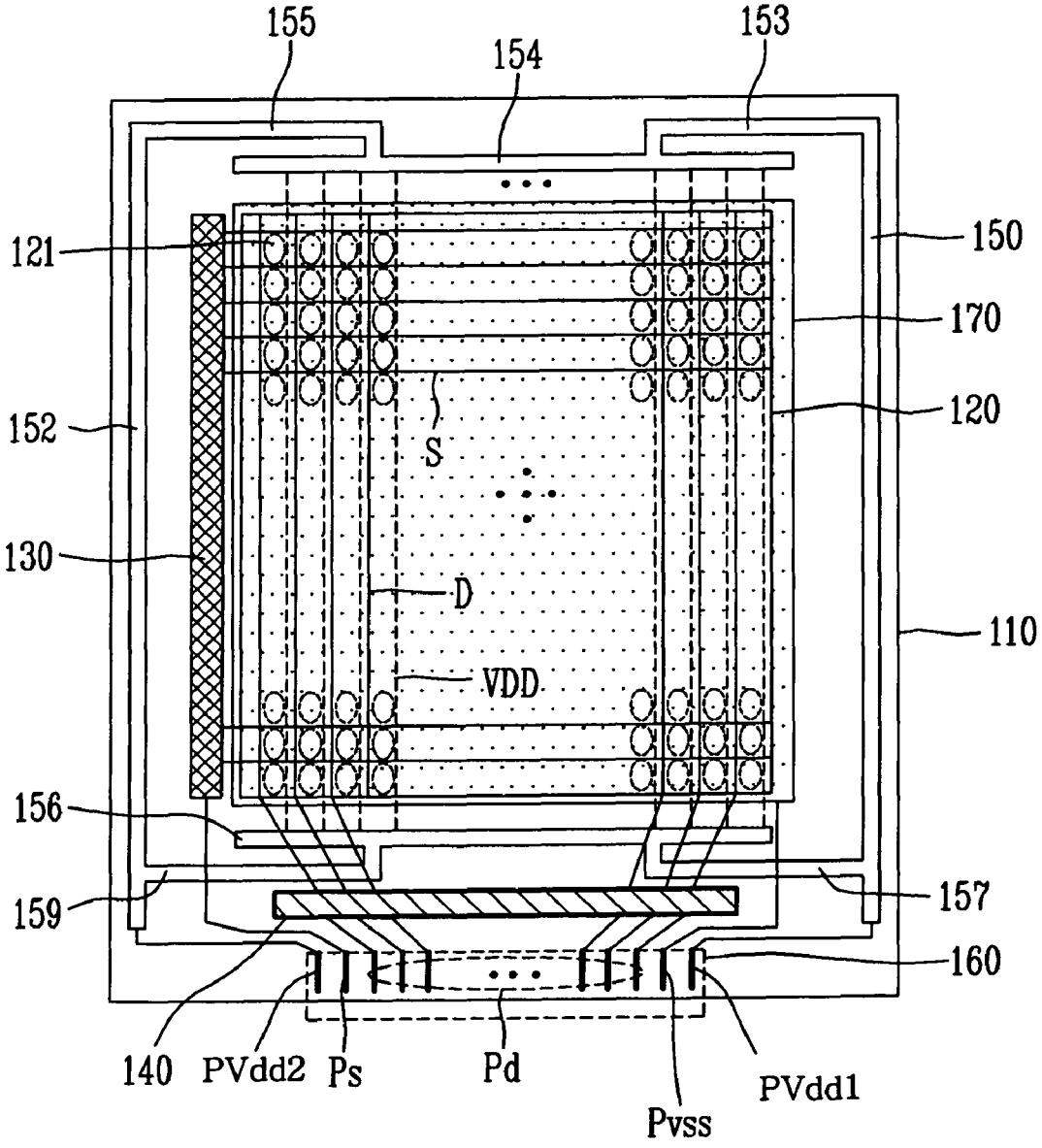
FIG. 2 is a plan view of a light emitting display according to a first embodiment of the present invention.

FIG. 2 is a plan view of a light emitting display according to a first embodiment of the present invention. A light emitting display according to the first embodiment of the present invention includes a pixel portion 120 placed on a substrate 110 and having a plurality of pixels 121 defined by a plurality of data lines D, a plurality of scan lines S, and a plurality of first pixel power lines VDD; first through fourth power lines 150, 152, 154 and 156; and first through fourth power connection lines 153, 155, 157 and 159. Further, the light emitting display according to an embodiment of the present invention includes a scan driver 130, a data driver 140, a second pixel power line 170 and a pad hub 160.

The scan driver 130 is placed adjacent to one side of the pixel portion 120 and is electrically connected to a first set of pads Ps on the pad hub 160. The scan driver 130 generates scan signals according to scan control signal lines extended from the first set of pads Ps and supplies the scan signals to the scan lines S of the pixel portion 120 in sequence.

The data driver 140 is electrically connected to the data line D and second set of pads on the pad hub 160. The data driver 140 can be directly formed on the substrate 110 or embedded as a chip onto the substrate 110. The chip type data driver can be embedded on the substrate 110 by a chip on glass method, a wire bonding method, a flip chip method, a beam lead bonding method, or similar technique. The data driver 140 receives a data control signal and a data signal from the second set of pads Pd and supplies the data signal to the data lines D based on the data control signal.

The first power line 150 is arranged in parallel on a first side (right side) of the pixel portion 120. The first power line 150 has a first end electrically connected to a third set of pads Pvdd1 on the pad hub 160. Further, the first power line 150 receives the first pixel driving voltage from the third set of pads Pvdd1 and supplies it to both the third power line 154 via the first power connection line 153 and the fourth power line 156 via the third power connection line 157.

The second power line 152 is arranged in parallel with a second side (left side) of the pixel portion 120. The second power line 152 has a first end electrically connected to a fourth set of pads Pvdd2 on the pad hub 160. Further, the second power line 152 receives the first pixel driving voltage from the fourth set of pads Pvdd2 and supplies it to both the third power line 154 via the second power connection line 155 and the fourth power line 156 via the fourth power connection line 159.

The third power line 154 is arranged in parallel with a top side of the pixel portion 120. The third power line 154 has a first end electrically connected to a first end (top end) of each first pixel power line VDD. Further, the third power line 154 supplies the first pixel driving voltage from the first and second power connection lines 153 and 155 to the first end of each pixel power line VDD.

The fourth power line 156 is arranged in parallel with a bottom side of the pixel portion 120. The fourth power line 156 has a first end electrically connected to a second end (bottom end) of each first pixel power line VDD. Further, the fourth power line 156 supplies the first pixel driving voltage from the third and fourth power connection lines 157 and 159 to the second end of each pixel power line VDD.

The first power connection line 153 has a "U"-shape and is electrically connected to the middle of the right portion of the third power line 154. The first power connection line 153 has a first end electrically connected to the top end of the first power line 150 and a second end electrically connected to the third power line 154. The second end of the first power connection line 153 is electrically connected to a region between the middle and the first end of the third power line 154 at a first electric junction. The distance from this first electric junction to the middle of the third power line 154 is equal to the distance from the first electric junction to the first end of the third power line 154. The first power connection line 153 supplies the first pixel driving voltage from the first power line 150 to the right portion of the third power line 154.

The second power connection line 155 has a "U"-shape and is electrically connected to the middle of the left portion of the third power line 154. The second power connection line 155 has a first end electrically connected to the top end of the second power line 152 and a second end electrically connected to the third power line 154 at a second electric junction. The distance from this second electric junction to the middle of the third power line 154 is equal to the distance from the electric junction to the second end of the third power line 154. The second power connection line 155 supplies the first pixel driving voltage from the second power line 152 to the left portion of the third power line 154.

The third power connection line 157 is electrically connected to the middle of the right portion of the fourth power line 156. The third power connection line 157 has a first end electrically connected to the bottom end of the first power line 150 and a second end electrically connected to the fourth power line 156 at a third electric junction. The distance from this third electric junction to the middle of the fourth power line 156 is equal to the distance from the third electric junction to the first end of the fourth power line 156.

The width and the length of the third power connection line 157 are designed to equalize the first pixel driving voltage supplied from the first power connection line 153 to the first electric junction on the third power line 154 with the first pixel driving voltage supplied from the third power connection line 157 to the third electric junction on the fourth power line 156. The third power connection line 157 can be narrower than the first power line 150. The third power connection line 157 drops and supplies the first pixel driving voltage from the first power line 150 to the right portion of the fourth power line 156 at the third electric junction.

The fourth power connection line 159 is electrically connected to the middle of the left portion of the fourth power line 156. The fourth power connection line 159 has a first end electrically connected to the bottom end of the second power line 152 and a second end electrically connected to the fourth power line 156 at a fourth electric junction. The distance from the fourth electric junction between the fourth power connection line 159 and the fourth power line 156 to the middle of the fourth power line 156 is equal to the distance from the fourth electric junction to the second end of the fourth power line 156.

The width and the length of the fourth power connection line 159 are designed to equalize the first pixel driving voltage supplied from the second power connection line 155 to the second electric junction with the first pixel driving voltage supplied from the fourth power connection line 159 to the fourth electric junction. The third and fourth power connection lines 157 and 159 are different in line resistance from the first and second power connection lines 153 and 155. The fourth power connection line 159 can be narrower than the second power line 152. The fourth power connection line 159 drops and supplies the first pixel driving voltage from the second power line 152 to the left portion of the fourth power line 156, i.e., through the fourth electric junction.

The second pixel power line 170 is formed on the whole area of the pixel portion 120. The second pixel power line 170 supplies a second pixel driving voltage from a fifth set of pads Pvss on the pad hub 160 to each pixel 121. The second pixel power line 170 is arranged in parallel with and separately from the scan line S of the pixel portion 120.

Each first pixel power line VDD has its first end electrically connected to the third power line 154 and its second end electrically connected to the fourth power line 156. Each first pixel power line VDD supplies the first pixel driving voltage from the third and fourth power lines 154 and 156 to each pixel 121. The first pixel driving voltages supplied to the first and second ends of each first pixel power line VDD are made uniform by the first through fourth power connection lines 153, 155, 157 and 159.

Each pixel 121 is controlled by the scan signal transmitted to the scan line S, and emits light based on current supplied to the light emitting device from the first pixel power line VDD, thereby displaying an image. Each pixel 121 includes a pixel circuit that outputs the current from the first pixel power line VDD in correspondence to the data signal transmitted to the data line D in response to the scan signal supplied from at least one scan line S. The pixel circuit includes at least one transistor and at least one capacitor.

Figure 3:
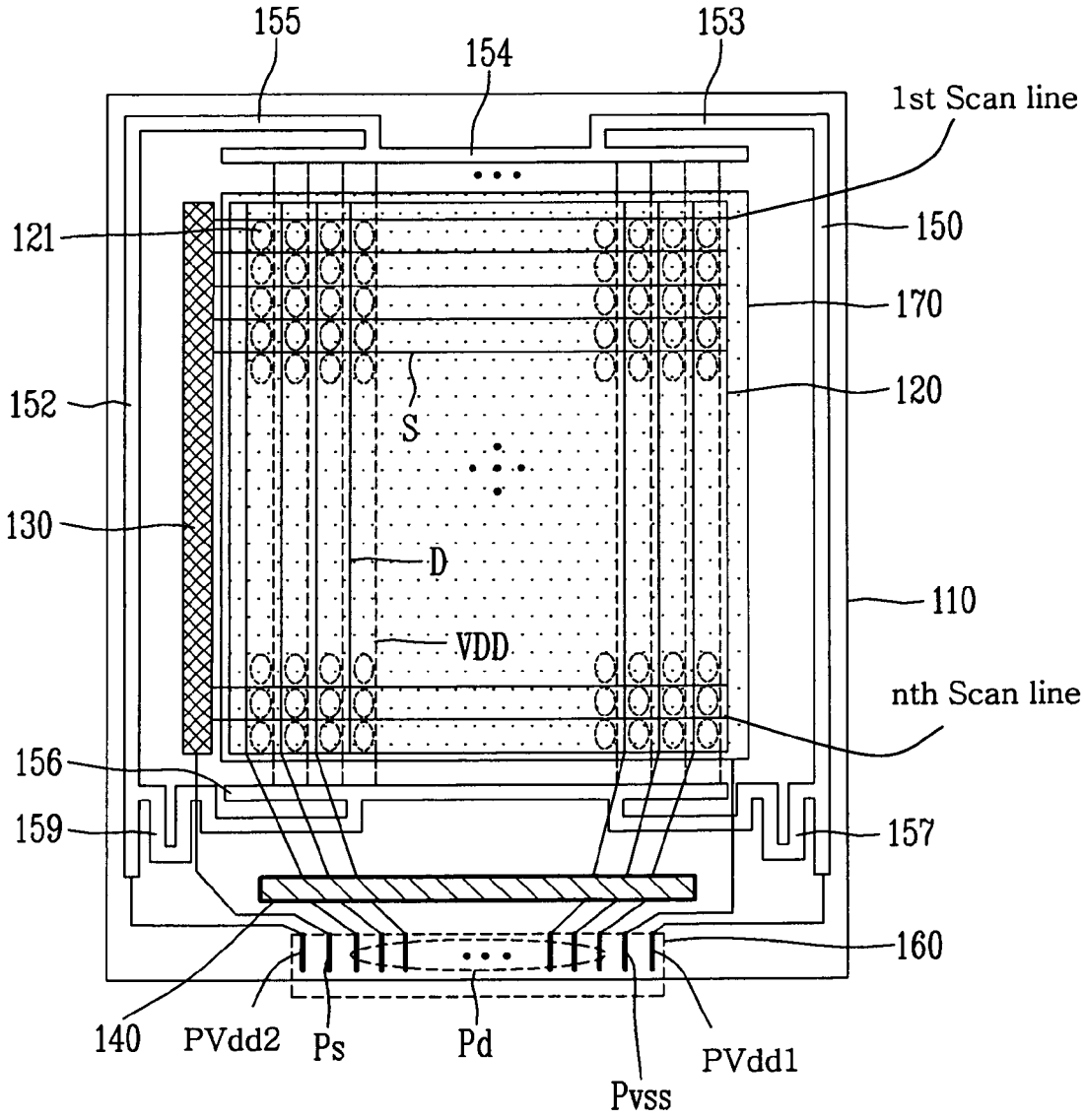
FIG. 3 is a plan view of a light emitting display according to a second embodiment of the present invention.

FIG. 3 is a plan view of a light emitting display according to a second embodiment of the present invention. A light emitting display according to the second embodiment of the present invention has the same configuration as that of the first embodiment except the third and fourth power connection lines 157 and 159.

The third power connection line 157 has a curved "S" shape and is electrically connected to the middle of the right portion of the fourth power line 156. The third power connection line 157 has a first end electrically connected to the bottom end of the first power line 150 and a second end electrically connected to the fourth power line 156. The second end of the third power connection line 157 is electrically connected to a region between the middle and the first end of the fourth power line 156 at a third electric junction. The distance from the third electric junction to the middle of the fourth power line 156 is equal to the distance from the third electric junction to the first end of the fourth power line 156.

The width and the length of the third power connection line 157 are designed to equalize the first pixel driving voltage supplied from the first power connection line 153 to the first electric junction of the third power line 154 with the first pixel driving voltage supplied from the third power connection line 157 to the third electric junction of the fourth power line 156. The third power connection line 157 can be narrower than the first power line 150. The third power connection line 157 drops and supplies the first pixel driving voltage from the first power line 150 to the right portion of the fourth power line 156, i.e., to the third electric junction.

The fourth power connection line 159 has a curved "S" shape and is electrically connected to the middle of the left portion of the fourth power line 156. The fourth power connection line 159 has a first end electrically connected to the bottom end of the second power line 152 and a second end electrically connected to the fourth power line 156. The second end of the fourth power connection line 159 is electrically connected to a region between the middle and the second end of the fourth power line 156 at the fourth electric junction. The distance from the fourth electric junction to the middle of the fourth power line 156 is equal to the distance from the fourth electric junction to the second end of the fourth power line 156.

The width and the length of the fourth power connection line 159 are designed to equalize the first pixel driving voltage supplied from the second power connection line 155 to the second electric junction of the third power line 154 with the first pixel driving voltage supplied from the fourth power connection line 159 to the fourth electric junction. The third and fourth power connection lines 157 and 159 have different line resistances from the first and second power connection lines 153 and 155. The fourth power connection line 159 can be narrower than the second power line 152. The fourth power connection line 159 drops and supplies the first pixel driving voltage from the second power line 152 to the left portion of the fourth power line 156, i.e., to the fourth electric junction.

Figure 4:
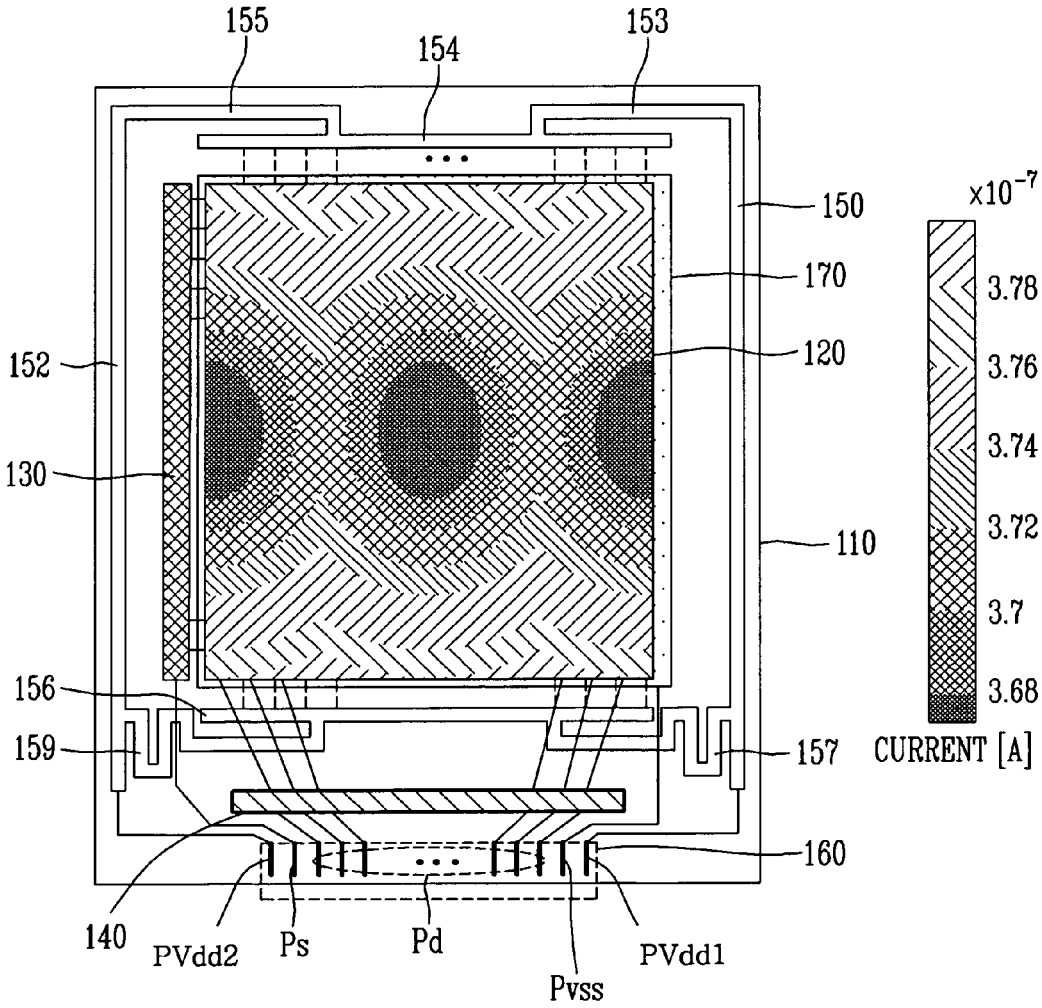
FIG. 4 shows current distribution of the light emitting display of FIG. 3 according to the position of the pixels.

FIG. 4 shows distribution of the current supplied to the pixel portion 120 shown in FIG. 3. The light emitting display according to the second embodiment of the present invention employs the third and fourth power connection lines 157 and 159 to provide a uniform first pixel driving voltage to be supplied to the third and fourth power lines 154 and 156, so that the uniformity of the current supplied to the pixel portion 120 is improved. Even though the current distribution illustrated in FIG. 4 is somewhat non-uniform because of the voltage drop in the first and second power lines 150 and 152 adjacent to the pixel portion 120 and the voltage drop in the first pixel power line VDD, the distribution flowing in the whole pixel portion 120 is generally symmetrically uniform with respect to horizontal and vertical directions. The current distribution of the pixel portion 120 provided in the light emitting display according to the first embodiment is also similar to that shown in FIG. 4.

Figure 5:
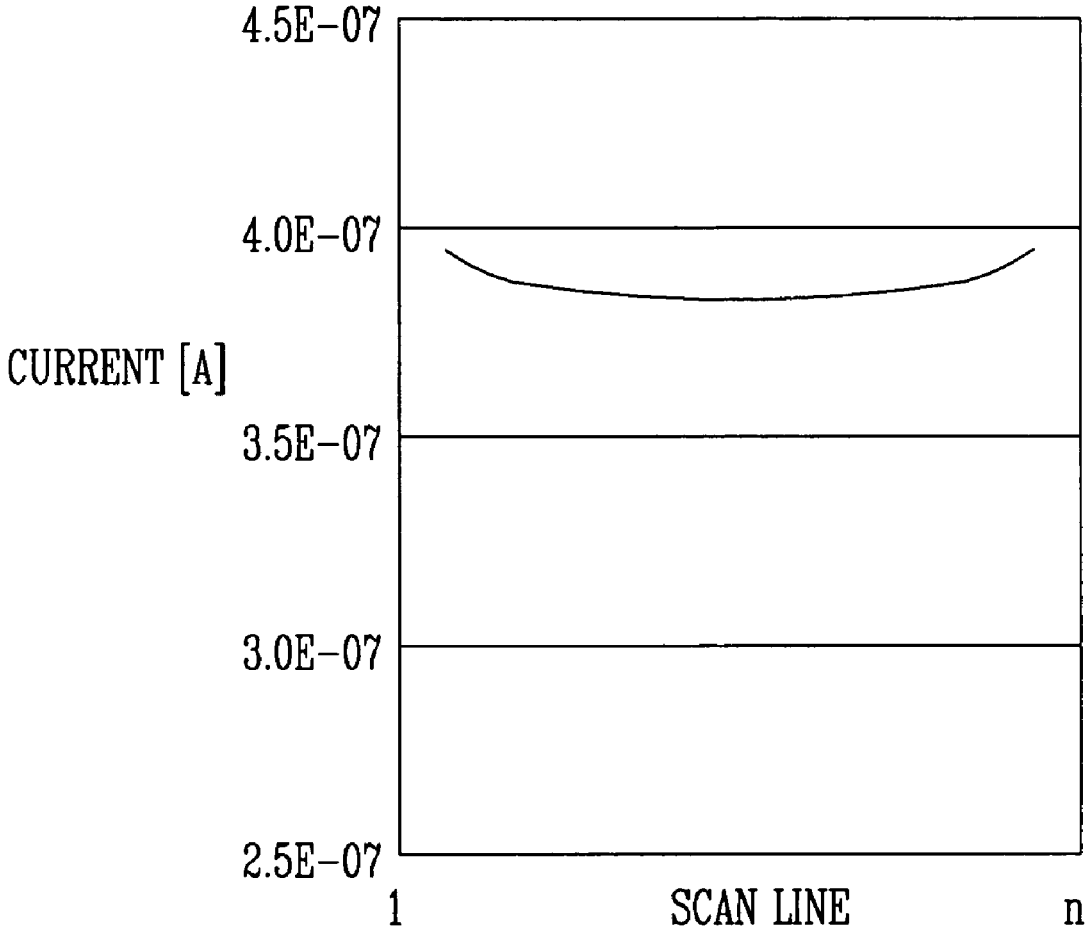
FIG. 5 is a graph illustrating the intensity of current supplied to each pixel connected to the scan line of FIGS. 2 and 3.

FIG. 5 is a graph illustrating the intensity of current supplied to each pixel 121 connected to the $1^{st}$ through $n^{th}$ scan lines shown in FIG. 3. The currents are symmetrically supplied to the respective pixels 121 connected to the $1^{st}$ through $n^{th}$ scan lines. The current flowing in the pixel portion 120 is uniform regardless of the side of the scan line, such as the top side corresponding to the $1^{st}$ scan line of the pixel portion 120 and the bottom side corresponding to the $n^{th}$ scan line of the pixel portion 120, because the first pixel driving voltage supplied to the first and second end of the first pixel power lines VDD is made uniform by the third and fourth power connection lines 157 and 159.

In the light emitting display according to the first and second embodiments of the present invention, the voltage drop of the first pixel driving voltage supplied to the third and fourth power lines 154 and 156 is made uniform by the third and fourth power connection lines 157 and 159, so that the current supplied from the first pixel power line VDD to the pixels 121 is uniform. In the light emitting display according to the first and second embodiments of the present invention, the uniform current flows in the whole pixel portion 120, so that the brightness is also uniform, thereby improving picture quality.

Figure 6:
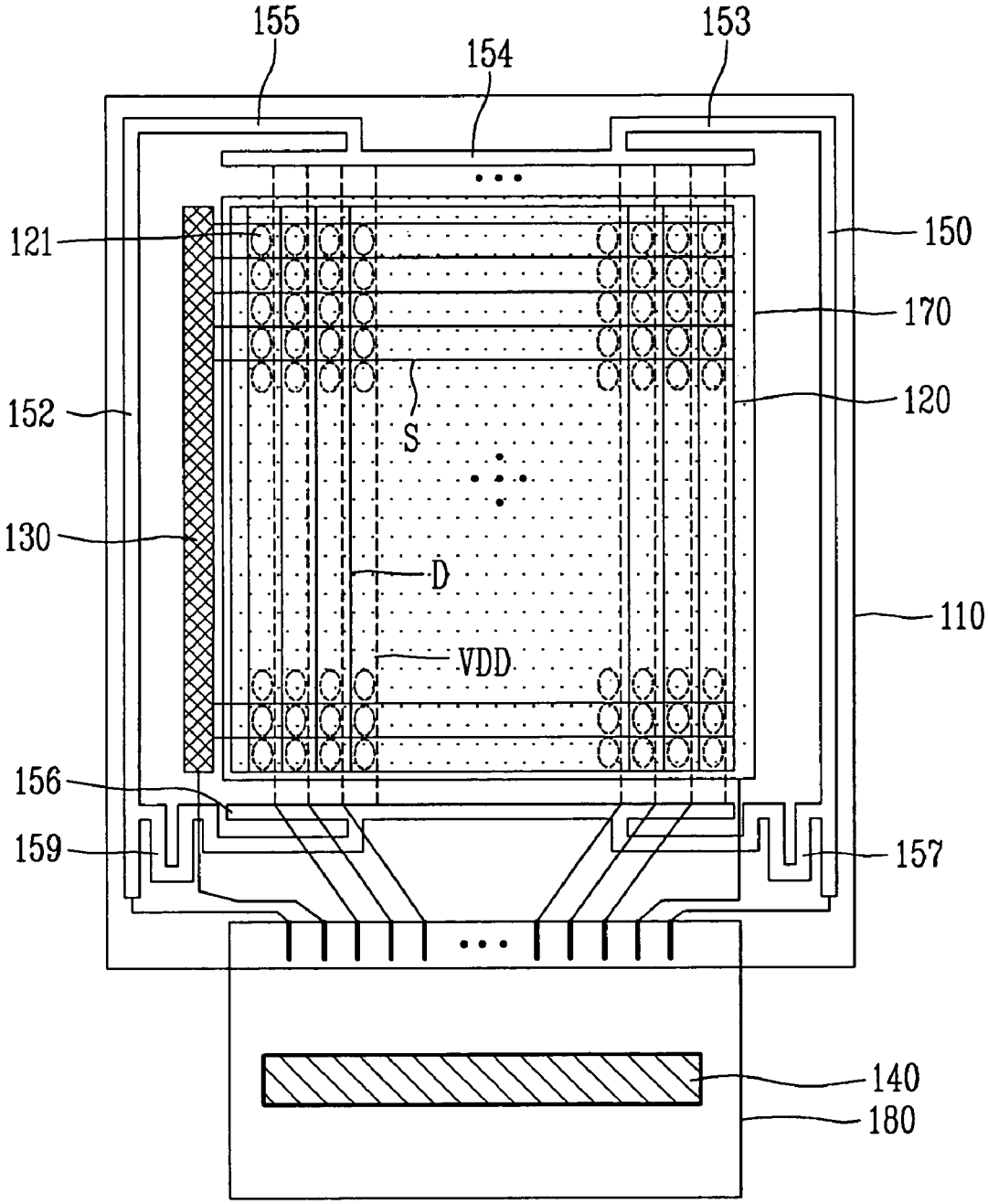
FIG. 6 is a plan view of a light emitting display according to a third embodiment of the present invention.

FIG. 6 is a plan view of a light emitting display according to a third embodiment of the present invention. The light emitting display according to the third embodiment of the present invention has the same configuration as those of the first and second embodiments except for the configuration of the data driver 140 supplying the data signal to the data line D of the pixel portion 120.

In the light emitting display according to the third embodiment of the present invention, the data driver 140 is embedded on a flexible printed circuit (FPC) 180 connected to the substrate 110. Thus, the data driver 140 is electrically connected with the data line D of the pixel portion 120 through the pad hub of the substrate 110, thereby supplying the data signal. In another embodiment, the data driver 140 may be embedded in a chip on board mounted on a printed circuit board, a chip on film directly mounted on a film or on a film type connector that is generally used for a tape carrier package, as well as, mounted on the flexible printed circuit 180.

As described above, the present invention provides a light emitting display, in which pixel driving voltages respectively applied to opposite ends of a pixel power line are made uniform and thus the currents supplied to the respective pixels are made uniform. The uniform current flows in the whole pixel portion, so that the brightness is uniform, thereby improving picture quality.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A light emitting display comprising:

a plurality of scan lines;

a plurality of pixel power lines;

a plurality of data lines;

a pixel portion including a plurality of pixels at regions defined by the plurality of scan lines, the plurality of pixel power lines, and the plurality of data lines;

a first power line arranged on a first side of the pixel portion for supplying a driving voltage;

a second power line arranged on a second side of the pixel portion for supplying the driving voltage, the second side being opposite to the first side with respect to the pixel portion;

a third power line arranged on a third side of the pixel portion for supplying the driving voltage to the plurality of pixel power lines, the third side being different from the first and second sides;

a fourth power line arranged on a fourth side of the pixel portion for supplying the driving voltage to the plurality of pixel power lines, the fourth side being opposite to the third side with respect to the pixel portion;

a first power connection line electrically connecting the first power line to the third power line through a first electric junction on the third power line;

a second power connection line electrically connecting the second power line to the third power line through a second electric junction on the third power line;

a third power connection line electrically connecting the first power line to the fourth power line through a third electric junction on the fourth power line; and a fourth power connection line electrically connecting the second power line to the fourth power line through a fourth electric junction on the fourth power line, wherein the driving voltage is provided by an external power supply at a single side, which is the fourth side, of the pixel portion and is first supplied from the external power supply to the first and second power lines, through which the driving voltage is then supplied to the third and fourth power lines, through which the driving voltage is then supplied to the plurality of pixel power lines, through which the driving voltage is then supplied to the pixel portion, and wherein the first, second, third, and fourth power lines and the first, second, third, and fourth power connection lines together comprise a closed loop that encompasses all of the pixels in the pixel portion.

2. The light emitting display according to claim 1, wherein the first power connection line electrically connects a first end of the first power line with the first electric junction, and wherein the second power connection line electrically connects a first end of the second power line with the second electric junction.

3. The light emitting display according to claim 1, wherein the third power connection line electrically connects a second end of the first power line with the third electric junction, and wherein the fourth power connection line electrically connects a second end of the second power line with the fourth electric junction.

4. The light emitting display according to claim 1, wherein the first electric junction and the second electric junction are located on the third power line and have a same length of a current path to the first power line and the second power line, respectively, as each other, and wherein the third electric junction and the fourth electric junction are located on the fourth power line and have the same length of a current path to the first power line and the second power line, respectively, as each other.

5. The light emitting display according to claim 1, wherein the first electric junction is electrically connected between a first end and a middle of the third power line, and wherein the second electric junction is electrically connected between a second end and the middle of the third power line.

6. The light emitting display according to claim 1, wherein the third electric junction is electrically connected between a first end and a middle of the fourth power line, and wherein the fourth electric junction is electrically connected between a second end and the middle of the fourth power line.

7. The light emitting display according to claim 1, wherein the third power connection line and the fourth power connection line have an S-shape.

8. The light emitting display according to claim 1, wherein the third power connection line and the fourth power connection line have a different line resistance from the first power connection line and the second power connection line.

9. The light emitting display according to claim 1, wherein the driving voltage supplied to the third electric junction and the fourth electric junction is equal to the driving voltage supplied to the first electric junction and the second electric junction.

10. The light emitting display according to claim 9, wherein the third power connection line drops and supplies the driving voltage from the first power line to the third electric junction, and wherein the fourth power connection line drops and supplies the driving voltage from the second power line to the fourth electric junction.

11. A light emitting display comprising:

a plurality of scan lines;

a plurality of pixel power lines;

a plurality of data lines;

a pixel portion including a plurality of pixels, each of the pixels for emitting light by receiving a current from one of the pixel power lines, the current corresponding to a data signal transmitted through one of the data lines in response to a scan signal transmitted through one of the scan lines;

a first power line arranged on a first side of the pixel portion, the first power line for supplying an external driving voltage;

a second power line arranged on a second side of the pixel portion, the second power line for supplying the external driving voltage, the second side being opposite to the first side with respect to the pixel portion;

a third power line arranged on a third side of the pixel portion, the third power line for supplying the driving voltage to a first end of each of the pixel power lines, the third side being different from the first and second sides;

a fourth power line arranged on a fourth side of the pixel portion, the fourth power line for supplying the driving voltage to a second end of each of the pixel power lines, the fourth side being opposite to the third side with respect to the pixel portion;

a first power connection line having a first end electrically connected to the first power line and a second end electrically connected between a first end and a middle of the third power line;

a second power connection line having a first end electrically connected to the second power line and a second end electrically connected between a second end and the middle of the third power line;

a third power connection line having a first end electrically connected to the first power line, and a second end electrically connected between a first end and a middle of the fourth power line; and a fourth power connection line having a first end electrically connected to the second power line and a second end electrically connected between a second end and the middle of the fourth power line, wherein the driving voltage is provided by an external power supply at a single side, which is the fourth side, of the pixel portion and is first supplied from the external power supply to the first and second power lines, through which the driving voltage is then supplied to the third and fourth power lines, through which the driving voltage is then supplied to the plurality of pixel power lines, through which the driving voltage is then supplied to the pixel portion, and wherein the first, second, third, and fourth power lines and the first, second, third, and fourth power connection lines together comprise a closed loop that encompasses all of the pixels in the pixel portion.

12. The light emitting display according to claim 11, wherein the third power connection line and the fourth power connection line have an S-shape.

13. The light emitting display according to claim 11, wherein the third power connection line and the fourth power connection line have different line resistance from the first power connection line and the second power connection line.

14. The light emitting display according to claim 11, wherein the driving voltage supplied to the fourth power line is equal to the driving voltage supplied to the third power line.

15. The light emitting display according to claim 14, wherein the third power connection line and the fourth power connection line drops the driving voltage supplied from each second end of the first power line and the second power line to be equal to the driving voltage supplied to the third power line, and wherein the third power connection line and the fourth power connection line supply the dropped driving voltage to the fourth power line.

* * * * *